US009422509B2

(12) United States Patent
Meier et al.

(10) Patent No.: US 9,422,509 B2
(45) Date of Patent: Aug. 23, 2016

(54) LIQUID DETERGENT WITH INCREASED CLEANING PERFORMANCE

(71) Applicant: Henkel AG & Co. KGaA, Duesseldorf (DE)

(72) Inventors: Frank Meier, Duesseldorf (DE); Sabine Schuemann, Neuss (DE); Luca Bellomi, Duesseldorf (DE); Matthias Sunder, Duesseldorf (DE); Paula Barreleiro, Ginsheim-Gustavsburg (DE); Birgit Gluesen, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 14/487,242

(22) Filed: Sep. 16, 2014

(65) Prior Publication Data

US 2015/0005220 A1 Jan. 1, 2015

Related U.S. Application Data

(63) Continuation of application No. PCT/EP2013/055524, filed on Mar. 18, 2013.

(30) Foreign Application Priority Data

Mar. 19, 2012 (DE) ..... 10 2012 204 270

(51) Int. Cl.

| | |
|---|---|
| ***C11D 1/18*** | (2006.01) |
| ***C11D 1/72*** | (2006.01) |
| ***C11D 1/83*** | (2006.01) |
| ***C11D 1/22*** | (2006.01) |
| ***C11D 1/04*** | (2006.01) |
| ***C11D 3/20*** | (2006.01) |
| ***C11D 3/00*** | (2006.01) |
| ***C11D 3/37*** | (2006.01) |
| ***C11D 1/02*** | (2006.01) |

(52) U.S. Cl.

CPC ..... *C11D 3/2003* (2013.01); *C11D 1/02* (2013.01); *C11D 1/72* (2013.01); *C11D 1/83* (2013.01); *C11D 3/0036* (2013.01); *C11D 3/3715* (2013.01); *C11D 3/3753* (2013.01); *C11D 3/3765* (2013.01)

(58) Field of Classification Search

CPC ..... C11D 1/18; C11D 1/72; C11D 1/83; C11D 3/0036; C11D 3/3715; C11D 1/04; C11D 1/22

USPC ..... 510/360, 361, 421, 426, 434, 475

See application file for complete search history.

(56) References Cited

U.S. PATENT DOCUMENTS

| | | | | | |
|---|---|---|---|---|---|
| 4,416,793 | A * | 11/1983 | Barrat et al. | ..... | 510/335 |
| 5,290,475 | A | 3/1994 | Wixon | | |
| 6,153,723 | A | 11/2000 | Lang et al. | | |
| 6,258,295 | B1 * | 7/2001 | Wehlage | ..... | C11D 3/3917 252/186.29 |
| 6,514,927 | B2 | 2/2003 | Lang et al. | | |
| 2009/0036641 | A1 | 2/2009 | Lang et al. | | |
| 2014/0189960 | A1 | 7/2014 | Himmrich et al. | | |

FOREIGN PATENT DOCUMENTS

| | | | | | |
|---|---|---|---|---|---|
| EP | 0629690 | A1 | 12/1994 | | |
| EP | 1354939 | * | 10/2003 | ..... | C11D 17/04 |
| EP | 1354939 | A1 | 10/2003 | | |
| GB | 1466639 | | 3/1977 | | |
| WO | 94/03570 | A1 | 2/1994 | | |
| WO | 96/16150 | A1 | 5/1996 | | |

OTHER PUBLICATIONS

PCT International Search Report (PCT/EP2013/055524) dated May 29, 2013.

* cited by examiner

*Primary Examiner* — Brian P Mruk
(74) *Attorney, Agent, or Firm* — P. Scott Smith

(57) ABSTRACT

The application describes a liquid washing or cleaning agent comprising a) an alkoxylated oxo alcohol with 7 or 8 alkoxy units and b) a polymer with a soil detachment capacity. The liquid washing or cleaning agent exhibits elevated cleaning performance, in particular on greasy soiling, and improved graying inhibition.

5 Claims, No Drawings

LIQUID DETERGENT WITH INCREASED CLEANING PERFORMANCE

FIELD OF THE INVENTION

The present invention generally relates to a liquid washing or cleaning agent comprising a polymer with a soil detachment capacity.

BACKGROUND OF THE INVENTION

The cleaning performance of washing or cleaning agents is improved by adding further components, which can be summarized under the heading "washing auxiliaries", in addition to the surfactants and builder materials indispensable for the washing process. Washing auxiliaries include for example foam regulators, graying inhibitors, bleaching agents, bleach activators and dye transfer inhibitors. Further washing auxiliaries are substances which impart soil-repelling properties to the laundry fibers and which, if present during the washing process, assist the soil detachment capacity of the other components of the washing agent. Such substances with a soil detachment capacity are often known as "soil release" active substances or, due to their capacity to provide a soil-repelling finish on the treated surface, for example fabric, as "soil repellents".

Soil release active substances known in the prior art are polyesters which contain dicarboxylic acid units, alkylene glycol units and polyalkylene glycol units. In particular, polyesters of phthalic acid and/or terephthalic acid or of the derivatives thereof, in particular polyesters prepared from ethylene terephthalates and/or polyethylene glycol terephthalates and/or polypropylene glycol terephthalates or anionically and/or nonionically modified derivatives of these are used in washing or cleaning agents.

Due to their chemical similarity to polyester fibers, these polyesters display particularly good soil detachment action on polyester-containing textile fabrics.

WO 96/16150 discloses that the cleaning performance of washing or cleaning agents can be increased by interaction of polymers with a soil detachment capacity with a surfactant combination prepared from ether sulfate and alkyl oligoethoxylates.

A requirement still, however, remains to improve the cleaning performance of washing or cleaning agents comprising a polymer with a soil detachment capacity.

BRIEF SUMMARY OF THE INVENTION

A liquid washing or cleaning agent comprising an alkoxylated oxo alcohol with 7 or 8 alkoxy units and a polymer with a soil detachment capacity.

Use of a combination of a polymer with a soil detachment capacity and an alkoxylated oxo alcohol with 7 or 8 alkoxy units in a liquid washing or cleaning agent for increasing cleaning performance on greasy soiling.

Use of a combination of a polymer with a soil detachment capacity and an alkoxylated oxo alcohol with 7 or 8 alkoxy units in a liquid washing or cleaning agent for increasing graying inhibition.

DETAILED DESCRIPTION OF THE INVENTION

The following detailed description of the invention is merely exemplary in nature and is not intended to limit the invention or the application and uses of the invention.

Furthermore, there is no intention to be bound by any theory presented in the preceding background of the invention or the following detailed description of the invention.

The present invention provides a liquid washing or cleaning agent comprising a polymer with a soil detachment capacity, which agent displays elevated cleaning performance. Furthermore, other desirable features and characteristics of the present invention will become apparent from the subsequent detailed description of the invention and the appended claims, taken in conjunction with the accompanying drawings and this background of the invention.

The object of the present invention is achieved by a liquid washing or cleaning agent comprising a) an alkoxylated oxo alcohol with 7 or 8 alkoxy units and b) a polymer with a soil detachment capacity.

It has surprisingly been found that the combination of oxo alcohols with 7 or 8 alkoxy units with a polymer with a soil detachment capacity gives rise to liquid washing or cleaning agents with elevated cleaning performance. Liquid washing or cleaning agents comprising the combination of oxo alcohols with 7 or 8 alkoxy units and a polymer with a soil detachment capacity display elevated cleaning performance on greasy soiling and improved graying inhibition.

Particularly elevated cleaning performance on greasy soiling and particularly good graying inhibition are obtained when $C_{13-15}$ oxo alcohols with 7 EO, $C_{13-15}$ oxo alcohols with 8 EU or a mixture of these two oxo alcohols are used in the liquid washing or cleaning agents.

It is furthermore preferred for the polymer with a soil detachment capacity to be a polyester of a dicarboxylic acid and a diol. It is here more preferable for the polymer with a soil detachment capacity to be an end group-terminated polyester prepared from terephthalic acid, polyethylene glycol and 1,2-propylene glycol, since these polyesters may be incorporated particularly effectively and stably into liquid washing or cleaning agents.

In a preferred embodiment, the washing or cleaning agent is packaged in a water-soluble covering. Portion packages containing liquid washing or cleaning agents fulfill the consumer's desire for simplified dispensing as well as the preference of consumers for liquid washing or cleaning agents.

It may be preferred for the liquid washing or cleaning agents to contain up to 10 wt. % water, relative to the entire washing or cleaning agent. Liquid washing or cleaning agents with a low water content are particularly advantageous for packaging in water-soluble coverings, since the risk of partial or complete dissolution of the water-soluble covering prior to use of the liquid washing or cleaning agent is minimized.

It is also preferred for the washing or cleaning agents to contain an amine-neutralized anionic surfactant. Neutralization with amines does not result in the formation of water and it is thus possible to produce washing or cleaning agents which are highly concentrated and/or have a low water content and are for example directly suitable for use in water-soluble coverings or can be offered for sale in smaller packaging units.

The present invention further provides the use of a combination of a polymer with a soil detachment capacity and an alkoxylated oxo alcohol with 7 or 8 alkoxy units in a liquid washing or cleaning agent for increasing cleaning performance on greasy soiling. The present invention likewise further provides the use of a combination of a polymer with a soil detachment capacity and an alkoxylated oxo alcohol with 7 or 8 alkoxy units in a liquid washing or cleaning agent for increasing graying inhibition.

The invention will be explained in greater detail below, inter alia with reference to examples.

The liquid washing or cleaning agent contains a polymer with a soil detachment capacity and an alkoxylated oxo alcohol with 7 or 8 alkoxy units.

Polymers with a soil detachment capacity which may in particular be used are polyesters preferably obtainable from terephthalic acid, isophthalic acid, sulfoisophthalic acid and/or the methyl esters thereof, aliphatic dicarboxylic acids (saturated and/or unsaturated), for example adipic acid, and/or the anhydrides thereof, aliphatic substituted dicarboxylic acids, for example nonylsuccinic acid, alkylene glycols, polyethylene glycols, alkyl polyethylene glycols, polyethylene glycol benzoic acid esters, polyethylene glycol sulfobenzoic acid esters and optionally alkanolamines.

Suitable polymers with a soil detachment capacity comprise for example polyesters prepared from polyethylene terephthalate and polyethylene glycol, polyesters of ethylene glycol, polyethylene glycol, aromatic dicarboxylic acid and sulfonated aromatic dicarboxylic acid, methyl or ethyl end group-terminated polyesters containing ethylene terephthalate and/or propylene terephthalate units and polyethylene oxide terephthalate units, polyesters which, in addition to oxyethylene groups and terephthalic acid units, also contain substituted ethylene units and glycerol units, or polyesters which, in addition to oxyethylene groups and terephthalic acid units, contain 1,2-propylene, 1,2-butylene and/or 3-methoxy-1,2-propylene groups and glycerol units and are end group-terminated with $C_1$ to $C_4$ alkyl groups.

Preferred polyesters with a soil detachment capacity include those which, in formal terms, are obtainable by esterifying two monomer moieties, the first monomer being a dicarboxylic acid HOOC-Ph-COOH and the second monomer a diol HO—(CHR—)$_a$OH, which may also be present as a polymeric diol H—(O—(CHR—)$_a$)$_b$OH. Ph here means an o-, m- or p-phenylene residue which may bear 1 to 4 alkyl residues with 1 to 22 C atoms, sulfonic acid groups, carboxyl groups and mixtures thereof, R means hydrogen, an alkyl residue with 1 to 22 C atoms and mixtures thereof, a means a number from 2 to 6 and b a number from 5 to 300. The polyesters producible therefrom preferably contain not only monomer diol units —O—(CHR—)$_a$O— but also polymer diol units —(O—(CHR—)$_a$)$_b$O—.

The acid on which the residue Ph is based is preferably selected from terephthalic acid, isophthalic acid, phthalic acid, trimellitic acid, mellitic acid, the isomers of sulfophthalic acid, sulfoisophthalic acid and sulfoterephthalic acid and mixtures thereof. Where the acid groups thereof are not part of the ester bond in the polymer with a soil detachment capacity, they are preferably present in salt form, in particular as an alkali metal or ammonium salt.

Preferred diols HO—(CHR—)$_a$OH include those in which R is hydrogen and a is a number from 2 to 6, and those in which a has the value 2 and R is selected from hydrogen and alkyl residues with 1 to 10, in particular 1 to 3 C atoms. Among the latter-stated diols, those of the formula HO—$CH_2$—CHR—OH, in which R has the above-stated meaning, are more preferred. Examples of diol components are ethylene glycol, 1,2-propylene glycol, 1,3-propylene glycol, 1,4-butanediol, 1,5-pentanediol, 1,6-hexanediol, 1,8-octanediol, 1,2-decanediol, 1,2-dodecanediol and neopentyl glycol.

The molar ratio of monomer diol units to polymer diol units preferably amounts to 100:1 to 1:100. In the polymer diol units, the degree of polymerization b is preferably in the range from 5 to 300, in particular from 10 to 80. The molecular weight or the average molecular weight or the maximum of the molecular weight distribution of preferred polyesters with a soil detachment capacity is preferably in the range from 250 to 100,000.

If desired, these preferred polymers with a soil detachment capacity may also be end group-terminated, wherein end groups which may in particular be considered are alkyl groups with 1 to 5 C atoms.

Particularly preferred polymers with a soil detachment capacity which are used are end group-terminated polyesters prepared from polyethylene glycols, terephthalic acid and ethylene glycol and/or 1,2-propylene glycol.

The quantity of polymer with a soil detachment capacity preferably amounts to between 0.5 and 10 wt. % and more preferably to between 1 and 5 wt. %, in each case relative to the entire washing or cleaning agent.

In addition to the polymer with a soil detachment capacity, the liquid washing or cleaning agents contain an alkoxylated oxo alcohol with 7 or 8 alkoxy units. Oxo alcohols are primary, partially branched higher alcohols which are obtained by oxo synthesis, in which oxo aldehydes or the primary aldol condensation products thereof are converted by catalytic hydrogenation into the corresponding oxo alcohols.

A $C_{13-15}$ oxo alcohol with 7 EO, a $C_{13-15}$ oxo alcohol with 8 EO or a mixture of these two oxo alcohols is preferably used in the liquid washing or cleaning agents.

The content of alkoxylated oxo alcohol with 7 or 8 alkoxy units preferably amounts to 5 to 35 wt. % and more preferably 10 to 25 wt. %, in each case relative to the entire liquid washing or cleaning agent.

In addition to the polymer with a soil detachment capacity and an alkoxylated oxo alcohol with 7 or 8 alkoxy units, the washing or cleaning agent may contain further ingredients which further improve the applicational and/or esthetic properties of the washing or cleaning agent. For the purposes of the present invention, the washing or cleaning agent preferably additionally contains one or more substances from the group of further nonionic surfactants, anionic surfactants, builders, bleaching agents, enzymes, electrolytes, pH adjusting agents, perfumes, perfume carriers, fluorescent agents, dyes, hydrotropes, foam inhibitors, silicone oils, antiredeposition agents, graying inhibitors, shrinkage prevention agents, anticrease agents, dye transfer inhibitors, antimicrobial active substances, non-aqueous solvents, germicides, fungicides, antioxidants, preservatives, corrosion inhibitors, antistatic agents, bitter agents, ironing aids, waterproofing and impregnation agents, skin-conditioning active substances, antiswelling and antislip agents, softening components and UV absorbers.

In addition to the alkoxylated oxo alcohol with 7 or 8 alkoxy units, the liquid washing or cleaning agent may for example contain further nonionic surfactants. Suitable nonionic surfactants include alkoxylated fatty alcohols, alkoxylated fatty acid alkyl esters, fatty acid amides, alkoxylated fatty acid amides, polyhydroxyfatty acid amides, alkylphenol polyglycol ethers, amine oxides, alkyl polyglucosides and mixtures thereof.

Preferably used alkoxylated fatty alcohols are ethoxylated, in particular primary alcohols with preferably 8 to 18 C atoms and on average 4 to 12 mol ethylene oxide (EO) per mol alcohol, in which the alcohol residue is linear. In particular, alcohol ethoxylates with 12 to 18 C atoms, for example prepared from coconut, palm, tallow fat or oleyl alcohol, and on average 5 to 8 EO per mol of alcohol are preferred. Preferred ethoxylated alcohols include, for example, $C_{12-14}$ alcohols with 4 EO or 7 EO, $C_{9-11}$ alcohol with 7 EU, $C_{12-18}$ alcohols with 5 EO or 7 EO and mixtures of these. The stated degrees of ethoxylation are statistical averages which, for a specific product, may be an integer or a fractional number. Preferred alcohol ethoxylates have a narrow homologue distribution (narrow range ethoxylates, NRE). In addition to these nonionic surfactants, fatty alcohols with more than 12 EO may also be used. Examples of these are tallow fatty alcohol with 14 EU, 25 EU, 30 EO or 40 EO. Nonionic surfactants containing EU and PO groups together in one molecule may also be used according to the invention. A mixture of a (relatively highly) branched ethoxylated fatty alcohol and an unbranched ethoxylated fatty alcohol, such as for example a mixture of a $C_{16-18}$ fatty alcohol with 7 EU and 2-propylheptanol with 7 EO, is furthermore suitable. The quantity of further nonionic surfactants preferably amounts to less than 5 wt. %, more preferably less than 2 wt. % and more preferably less than 1 wt. %, in each case relative to the entire quantity of liquid washing or cleaning agent.

The liquid washing or cleaning agent additionally to contain an anionic surfactant. Suitable anionic surfactants comprise alkylbenzenesulfonic acid salts, olefinsulfonic acid salts, $C_{12-18}$ alkanesulfonic acid salts, salts of sulfuric acid monoesters with a fatty alcohol, a fatty acid soap, salts of sulfuric acid monoesters with an ethoxylated fatty alcohol or a mixture of two or more of these anionic surfactants. Among these anionic surfactants, alkylbenzenesulfonic acid salts, fatty acid soaps and mixtures thereof are more preferred. The content of anionic surfactant preferably amounts to 5 to 50 wt. % and more preferably 10 to 40 wt. %, in each case relative to the entire liquid washing or cleaning agent.

Surfactants of the sulfonate type which may here preferably be considered are $C_{9-13}$ alkylbenzenesulfonates, olefinsulfonates, i.e. mixtures of alkenesulfonates and hydroxyalkanesulfonates and disulfonates, as are obtained, for example, from $C_{12-18}$ monoolefins with a terminal or internal double bond by sulfonation with gaseous sulfur trioxide and subsequent alkaline or acidic hydrolysis of the sulfonation products. $C_{12-11}$ alkanesulfonates and the esters of α-sulfofatty acids (ester sulfonates), for example the α-sulfonated methyl esters of hydrogenated coconut, palm kernel or tallow fatty acids, are also suitable.

Preferred alk(en)ylsulfates are the salts of sulfuric acid semi-esters of $C_{12}$-$C_{18}$ fatty alcohols for example prepared from coco fatty alcohol, tallow fatty alcohol, lauryl, myristyl, cetyl or stearyl alcohol or $C_{10}$-$C_{20}$ oxo alcohols and those semi-esters of secondary alcohols of these chain lengths. $C_{12}$-$C_{16}$ alkylsulfates and $C_{12}$-$C_{15}$ alkylsulfates and $C_{14}$-$C_{15}$ alkylsulfates are preferred because of their washing characteristics. 2,3-Alkylsulfates are also suitable anionic surfactants.

The sulfuric acid monoesters of straight-chain or branched $C_{7-21}$ alcohols ethoxylated with 1 to 6 mol of ethylene oxide are also suitable, such as 2-methyl-branched $C_{9-11}$ alcohols with on average 3.5 mol ethylene oxide (EO) or $C_{12-18}$ fatty alcohols with 1 to 4 EO.

Fatty acid soaps are further suitable anionic surfactants. Saturated and unsaturated fatty acid soaps are in particular suitable, such as the salts of lauric acid, myristic acid, palmitic acid, stearic acid, (hydrogenated) erucic acid and behenic acid and in particular soap mixtures derived from natural fatty acids, for example coconut, palm kernel, olive oil or tallow fatty acids.

The anionic surfactants including the fatty acid soaps may be present in the form of the sodium, potassium, magnesium or ammonium salts thereof. The anionic surfactants are preferably present in the form of the sodium or ammonium salts thereof. Amines usable for neutralization are preferably choline, triethylamine, monoethanolamine, diethanolamine, triethanolamine, methylethylamine or a mixture thereof, wherein monoethanolamine is preferred.

In a very particularly preferred embodiment, the liquid washing or cleaning agent contains an alkylbenzenesulfonic acid, in particular $C_{9-13}$-alkylbenzenesulfonic acid, neutralized with monoethanolamine and/or a fatty acid neutralized with monoethanolamine.

The total quantity of amine-neutralized anionic surfactant and an alkoxylated oxo alcohol with 7 or 8 alkoxy units in the liquid washing or cleaning agents preferably amounts to up to 85 wt. %, preferably 40 to 75 wt. % and more preferably 50 to 70 wt. %, relative to the entire liquid washing or cleaning agent.

The washing or cleaning agent is liquid. The washing or cleaning agents may contain water, wherein the water content amounts to less than 10 wt. % and more preferably less than 8 wt. %, in each case relative to the total liquid washing or cleaning agent.

The liquid washing or cleaning agent may be introduced into a water-soluble covering and thus be a component of a water-soluble package. If the liquid washing or cleaning agent is packaged in a water-soluble covering, it is preferred for the content of water to amount to less than 10 wt. %, relative to the entire liquid washing or cleaning agent, and for the anionic surfactants to be present in the form of the ammonium salts thereof.

Neutralization with amines, unlike neutralization with bases such as NaOH or KOH, does not result in the formation of water. Liquid washing or cleaning agents with a low water content which are directly suitable for use in water-soluble coverings may thus be produced.

In addition to the liquid washing or cleaning agent, a water-soluble package contains a water-soluble covering. The water-soluble covering is preferably formed by a water-soluble film material. Such water-soluble packages may be produced by either vertical form fill sealing (VFFS) methods or thermoforming methods.

Thermoforming generally includes forming a first layer of a water-soluble film material to produce indentations for receiving a composition, introducing the composition into the indentations, covering the indentations filled with the composition with a second layer of a water-soluble film material and sealing the first and second layers together at least around the indentations.

The water-soluble covering is preferably made of a water-soluble film material selected from the group consisting of polymers or polymer blends. The covering may be formed of one or of two or more layers of the water-soluble film material. The water-soluble film material of the first layer and further layers, if present, may be identical or different.

It is preferred for the water-soluble covering to contain polyvinyl alcohol or a polyvinyl alcohol copolymer.

Suitable water-soluble films for producing the water-soluble covering are preferably based on a polyvinyl alcohol or a polyvinyl alcohol copolymer, the molecular weight of which is in the range from 10,000 to 1,000,000 $gmol^{-1}$, preferably from 20,000 to 500,000 $gmol^{-1}$, more preferably from 30,000 to 100,000 $gmol^{-1}$ and in particular from 40,000 to 80,000 $gmol^{-1}$.

Polyvinyl alcohol is conventionally produced by hydrolysis of polyvinyl acetate, since the direct synthetic pathway is not possible. The same is true of polyvinyl alcohol copolymers, which are accordingly produced from polyvinyl acetate copolymers. It is preferred for at least one layer of the water-soluble covering to comprise a polyvinyl alcohol having a degree of hydrolysis of 70 to 100 mol %, preferably of 80 to 90 mol %, more preferably of 81 to 89 mol % and in particular of 82 to 88 mol %.

Additional polymers selected from the group comprising acrylic acid-containing polymers, polyacrylamides, oxazoline polymers, polystyrenesulfonates, polyurethanes, polyesters, polyethers, polylactic acid and/or mixtures of the above polymers may additionally be added to a film material suitable for producing the water-soluble covering.

In addition to vinyl alcohol, preferred polyvinyl alcohol copolymers comprise dicarboxylic acids as further monomers. Suitable dicarboxylic acids are itaconic acid, malonic acid, succinic acid and mixtures thereof, wherein itaconic acid is preferred.

In addition to vinyl alcohol, preferred polyvinyl alcohol copolymers likewise comprise an ethylenically unsaturated carboxylic acid, the salt thereof or the esters thereof. In addition to vinyl alcohol, such polyvinyl alcohol copolymers more preferably contain acrylic acid, methacrylic acid, acrylic acid esters, methacrylic acid esters or mixtures thereof.

Suitable water-soluble films for use in the coverings of the water-soluble packages according to the invention are films which are distributed for example by MonoSol LLC for example under the names M8630, C8400 or M8900. Other suitable films comprise films known as Solublon® PT, Solublon® GA, Solublon® KC or Solublon® KL from Aicello Chemical Europe GmbH or VF-HP films from Kuraray.

The water-soluble package comprising the liquid washing or cleaning agent and the water-soluble covering may comprise one or more chambers. The water-soluble packages with one chamber may have a substantially dimensionally stable spherical, cushion-like configuration with a circular, elliptical, square or rectangular basic shape. The liquid washing or cleaning agent may be contained in one or more chambers, if present, of the water-soluble covering.

In a preferred embodiment, the water-soluble package comprises two chambers. In this embodiment, the first chamber contains the liquid washing or cleaning agents and the second chamber a solid or a liquid agent, preferably a solid or a liquid washing or cleaning agent.

The agents contained in the different chambers of a water-soluble package with two or more chambers may have the same composition.

The agents, which are preferably all washing or cleaning agents, in a water-soluble package with at least two chambers preferably comprise compositions which differ at least in one ingredient or at least in the content of an ingredient.

Water-soluble packages with at least two chambers have the advantage that incompatible ingredients can be present in separate chambers. A further advantage arises in the case of suspensions containing solid and liquid ingredients, which are often regarded by the user of the water-soluble package as unesthetic and/or defective. In such a case the solid or insoluble ingredients can be contained in a separate chamber of the water-soluble package.

EXAMPLES

Liquid washing or cleaning agents were produced using conventional, known procedures and methods. Table 1 below shows the compositions of four washing or cleaning agents according to the invention (Inv. 1 to Inv. 4) and four washing or cleaning agents not according to the invention (Comp. 1 to Comp. 4).

TABLE 1

Liquid washing or cleaning agents Inv. 1 to Inv. 4 and Comp. 1 to Comp. 4 [all quantities are stated in wt. % of active substance, relative to the composition]

| Ingredients | Inv. 1 | Inv. 2 | Inv. 3 | Inv. 4 | Comp. 1 | Comp. 2 | Comp. 3 | Comp. 4 |
|---|---|---|---|---|---|---|---|---|
| $C_{10}$-$C_{13}$ alkylbenzene-sulfonic acid | 20 | 2 | 17 | 20 | 20 | 20 | 20 | 20 |
| $C_{13}$-$C_{15}$ oxo alcohol with 8 EO | 18 | — | 19 | — | 18 | — | — | — |
| $C_{13}$-$C_{15}$ oxo alcohol with 7 EO | — | 7 | — | 18 | — | 18 | — | — |
| $C_{12-18}$ fatty alcohol with 7 EO | — | — | — | — | — | — | 18 | 18 |
| $C_{12-18}$ fatty acid | 12 | 4.5 | 15 | 12 | 12 | 12 | 12 | 12 |
| Na lauryl ether sulfate (2EO) | 5 | 11 | — | 5 | 5 | 5 | 5 | 5 |
| $C_{12-14}$ alkyl polyglycoside | — | 2 | — | — | — | — | — | — |
| Soil-release polymer* | 2 | 1.3 | 1.5 | 2 | — | — | — | 2 |
| Glycerol | 4 | 5 | 22 | 4 | 4 | 4 | 4 | 4 |
| 1,2-Propanediol | 5.2 | — | 9 | 5.2 | 5.2 | 5.2 | 5.2 | 5.2 |
| Ethanol | 2 | — | 3.3 | 2 | 2 | 2 | 2 | 2 |
| Phosphonate | 0.7 | 0.5 | 0.9 | 0.7 | 0.7 | 0.7 | 0.7 | 0.7 |
| Monoethanolamine | 10 | — | 7 | 10 | 10 | 10 | 10 | 10 |
| NaOH (50%) | — | 1.9 | — | — | — | — | — | — |
| Citric acid | 2.3 | 2 | — | 2.3 | 2.3 | 2.3 | 2.3 | 2.3 |
| Boric acid | 1 | 1 | — | 1 | 1 | 1 | 1 | 1 |
| Dyes, enzymes (cellulase, amylase & protease), optical brighteners, perfume | 4.5 | 4.5 | 1.8 | 4.5 | 4.5 | 4.5 | 4.5 | 4.5 |
| Water | to 100 | to 100 | to 100 | to 100 | to 100 | to 100 | to 100 | to 100 |

*soil-release polymer = Texcare ® SRN 170 (from Clariant)

In order to determine the "soil-release" performance of the liquid washing or cleaning agents, various pieces of polyester cloth were firstly washed three times at 40° C. in each case with 35 g of the liquid washing or cleaning agent to be tested, Inv. 1 or Comp. 1, in a domestic washing machine (Miele W 1514) with 3.5 kg of accompanying laundry and were thereafter provided with greasy soiling with a diameter of in each case approximately 2 cm.

A domestic washing machine (Miele W 114) was then loaded with 3.5 kg of accompanying laundry and the soiled pieces of polyester cloth. In addition, 35 g of the washing agent to be tested, Inv. 1 or Comp. 1, were apportioned and washing was performed six times at 40° C. After drying by hanging and mangling of the pieces of material, the remission thereof was determined by spectrophotometry (Minolta CR200-1) as the Y value (see Table 2). Stain removal was assessed on the basis of the Y value.

TABLE 2

Whiteness (mean of 6 determinations)

| | Inv. 1 vs. Comp. 1 |
|---|---|
| Sebaceous matter (dyed blue) | +19.7 |
| Dust/sebaceous matter with mineral oil | +10.4 |
| Used engine oil | +8.7 |
| Make-up (Sans Soucis) | +7.8 |
| Make-up (Manhattan) | +3.1 |
| Black shoe polish (Kiwi) | +13.1 |

The results clearly show that the liquid washing or cleaning agent Inv. 1 has greater cleaning performance, in particular "soil-release" performance, on greasy soiling than a washing or cleaning agent without a polymer with soil detachment capacity.

Investigations into graying inhibition were moreover carried out with liquid washing or cleaning agents Inv. 1, Inv. 4 and Comp. 1 to Comp. 4.

To this end, various test fabrics were washed at 40° C. five times in succession with in each case 20 g of the liquid washing or cleaning agent to be tested, Inv. 1, Inv. 4, Comp. 1, Comp. 2, Comp. 3 or Comp. 4, in a domestic washing machine (Miele W 1514) in each case with 5 SBL 2004 cloths with standardized soil loading (soil ballast 32 g).

After drying by hanging and mangling of the laundry, the whiteness thereof was determined by spectrophotometry. Table 3 compares these measured values with the respective initial value for the test fabric.

The cotton fabric comprises eight different commercially obtainable cotton fabrics. The synthetic fabric comprises ten different commercially obtainable fabrics made for example from polyamide, viscose, polyester, polyester-cotton blends, Lycra-elastane blends and polyacrylonitrile. The everyday fabrics are four conventional commercial everyday textiles such as for example kitchen, terry, huckaback weave towels and white T-shirts.

TABLE 3

Whiteness (mean of the respective fabric)

| Washing or cleaning agent | Cotton | Synthetic | Everyday | Total |
|---|---|---|---|---|
| Inv. 1 | −9.8 | −7.2 | −13.4 | −10.1 |
| Inv. 4 | −10.3 | −8.4 | −9.8 | −9.5 |
| Comp. 1 | −10.9 | −11.2 | −13.4 | −11.8 |
| Comp. 2 | −12.7 | −9.0 | −13.6 | −11.8 |
| Comp. 3 | −13.5 | −9.3 | −14.8 | −12.5 |
| Comp. 4 | −12.1 | −8.3 | −14.4 | −11.6 |

The results clearly show that, by using a combination of a polymer with a soil detachment capacity and an alkoxylated oxo alcohol with 7 or 8 alkoxy units, it is possible to increase the cleaning performance in terms of graying inhibition of a liquid washing or cleaning agent not only on polyester fabrics, but in particular also on cotton fabrics. The combination of a polymer with a soil detachment capacity and an alkoxylated oxo alcohol with 8 alkoxy units here displays particularly good cleaning performance in terms of graying inhibition on synthetic fabrics, while the combination of a polymer with a soil detachment capacity and an alkoxylated oxo alcohol with 7 alkoxy units displays particularly good cleaning performance in terms of graying inhibition on everyday fabrics.

To produce water-soluble packages containing washing or cleaning agent Inv. 3, an M 8630 grade film (from Monosol) with a thickness of 76 μm was drawn by vacuum into a depression to form an indentation. The indentation was then filled with 30 ml of the liquid washing or cleaning agent Inv. 3. After covering the indentations filled with the agent with a second layer of an M 8630 grade film, the first and second layers were sealed together. The sealing temperature was 150° C. and the sealing duration was 1.1 seconds.

After 4, 8 and 12 weeks' storage of the water-soluble packages containing the washing or cleaning agent Inv. 3 under different climatic conditions, no partial or complete dissolution of the water-soluble covering was to be observed. In addition, no pores or holes which would likewise result in product escaping or leaking out could be identified.

Water-soluble packages containing the washing or cleaning agents Inv. 3 dissolved without residue in washing cycles at temperatures in the range from 20 to 95° C. and displayed a very good soil-release cleaning performance, in particular on greasy soiling, and very good cleaning performance in terms of graying inhibition.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A liquid washing or cleaning agent comprising a) a $C_{13}$-$C_{15}$ alkoxylated oxo alcohol with 8 alkoxy units and b) a polymer with a soil detachment capacity, wherein the polymer with a soil detachment capacity is a polyester of dicarboxylic acid and a diol and wherein the solid detachment capacity is an end group-terminated polyester prepared form terephthalic acid, polyethylene glycol and 1,2-propylene glycol, c) a $C_{12}$-$C_{18}$ fatty acid; and d) a $C_{10}$-$C_{13}$ alkylbenzene sulfonic acid, wherein the liquid washing or cleaning agent is packaged in a water-soluble covering.

2. The liquid washing or cleaning agent according to claim 1, wherein, the washing or cleaning agent contains up to 10% water relative to the entire washing or cleaning agent.

3. The liquid washing or cleaning agent according to claim 1, wherein the washing or cleaning agent further contains an amine-neutralized anionic surfactant.

4. A method of increasing cleaning performance of greasy soiled cloth, comprising: washing the greasy soiled cloth in water in the presence of a liquid washing or cleaning agent comprising a polymer with a soil detachment capacity diol, wherein the solid detachment capacity is an end group-terminated polyester prepared form terephthalic acid, polyethylene glycol and 1,2-propylene glycol, an $C_{13}$-$C_{15}$ alkoxylated oxo alcohol with 8 alkoxy units a $C_{12}$-$C_{18}$ fatty acid; and a $C_{10}$-$C_{13}$ alkylbenzene sulfonic acid all in a liquid washing or cleaning agent, wherein the polymer with a soil detachment capacity is a polyester of dicarboxylic acid and a diol and wherein the washing or cleaning agent is packaged in a water-soluble covering.

5. A method of increasing graying inhibition of a cloth, comprising washing the cloth in water in the presence of a liquid washing or cleaning agent comprising a polymer with a soil detachment capacity wherein the solid detachment capacity is an end group-terminated polyester prepared form terephthalic acid, polyethylene glycol and 1,2-propylene glycol, an $C_{13}$-$C_{15}$ alkoxylated oxo alcohol with 8 alkoxy units a $C_{12}$-$C_{18}$ fatty acid; and a $C_{10}$-$C_{13}$ alkylbenzene sulfonic acid all in a liquid washing or cleaning agent, wherein the polymer with a soil detachment capacity is a polyester of dicarboxylic acid and a diol and wherein the washing or cleaning agent is packaged in a water-soluble covering.

* * * * *